US007011050B2

(12) United States Patent
Suda et al.

(10) Patent No.: US 7,011,050 B2
(45) Date of Patent: Mar. 14, 2006

(54) CONTROL METHOD OF ELECTRONIC CONTROL THERMOSTAT

(75) Inventors: Norio Suda, Tokyo (JP); Mitsuhiro Sano, Tokyo (JP); Daisuke Tsukamoto, Tokyo (JP)

(73) Assignee: Nippon Thermostat Co., Ltd., Tokyo (JP)

( * ) Notice: Subject to any disclaimer, the term of this patent is extended or adjusted under 35 U.S.C. 154(b) by 149 days.

(21) Appl. No.: 10/472,497

(22) PCT Filed: Nov. 14, 2002

(86) PCT No.: PCT/JP02/11900

§ 371 (c)(1),
(2), (4) Date: Oct. 1, 2003

(87) PCT Pub. No.: WO03/060297

PCT Pub. Date: Jul. 24, 2003

(65) Prior Publication Data

US 2004/0098174 A1 May 20, 2004

(30) Foreign Application Priority Data

Jan. 9, 2002 (JP) ..... 2002-002613

(51) Int. Cl.
*F01P 7/14* (2006.01)

(52) U.S. Cl. ..... 123/41.1; 123/41.09

(58) Field of Classification Search ..... 123/41.1, 123/41.09

See application file for complete search history.

(56) References Cited

U.S. PATENT DOCUMENTS 4,545,333 A * 10/1985 Nagumo et al. ..... 123/41.1
4,616,599 A * 10/1986 Taguchi et al. ..... 123/41.1
6,109,219 A 8/2000 Sano

FOREIGN PATENT DOCUMENTS

| | | |
|---|---|---|
| JP | 10-8960 | 1/1998 |
| JP | 10-131753 | 5/1998 |
| JP | 2000-45773 | 2/2000 |
| JP | 2001-295647 | 10/2001 |

* cited by examiner

*Primary Examiner*—Noah Kamen
(74) *Attorney, Agent, or Firm*—Oblon, Spivak, McClelland, Maier & Neustadt, P.C.

(57) ABSTRACT

A method for controlling an electronically controlled thermostat provided in a cooling system of an internal combustion engine includes predicting a thermal radiation amount of a radiator when a water temperature of engine cooling water is stabilized at a second set temperature or at a first set temperature without detecting the water temperature not to cause temperature hunting, when the water temperature is controlled from a first set temperature to the second set temperature lower than the first set temperature or from the second set temperature to the first set temperature. The electronically controlled thermostat is controlled in accordance with the predicted thermal radiation amount.

16 Claims, 10 Drawing Sheets

CONTROL METHOD OF ELECTRONIC CONTROL THERMOSTAT

TECHNICAL FIELD

The present invention relates to a control method for an electronically controlled thermostat that is used to control the temperature of cooling water in an engine cooling system that variably sets the cooling water temperature in accordance with the load of the internal combustion engine (called the 'engine' hereinafter) employed in an automobile or the like.

BACKGROUND ART

A water-cooling type cooling device that employs a radiator is generally used in an automobile engine in order to cool same. Further, conventionally, with the object of improving the fuel consumption of the automobile, this type of cooling device employs a control valve, such as a thermostat, for example, for adjusting the amount of cooling water circulated to the radiator so as to permit control of the temperature of the cooling water introduced to the engine. Known examples of such thermostats include those which employ a thermally expanding body as a temperature sensor or those which are electrically controlled, and so forth.

A thermostat of this kind is constituted such that the valve portion thereof is interposed in part of a cooling water passage such that when the cooling water temperature is low, the valve portion is closed so that cooling water is circulated via a bypass passage without passing through the radiator, and, when the cooling water temperature is high, the temperature of the cooling water can be controlled to the required state by closing the valve portion so that the cooling water is circulated via the radiator.

Further, it is generally known that the fuel consumption of the automobile is improved by reducing the cooling water temperature when the engine is running with a high load and raising the cooling water temperature when the load is low.

In view of this situation, most recently, electronic-control type valves, that is, electronically controlled thermostats have been widely adopted in order to provide the optimum water temperature for improving automobile fuel consumption. Such an electronically controlled thermostat controls the cooling water temperature by optionally controlling the opening ratio of the valve portion and controlling a cooling fan that is attached to the radiator, whereby appropriate control of the cooling water temperature is possible.

This is because a control device (engine control module) that variably controls the above-described electronically controlled thermostat is capable of performing control also through the addition of detected information such as information on a variety of parameters of the engine control unit, such as the cooling water temperature, the outside air temperature, the engine revolution speed, and throttle opening ratio, for example.

A multiplicity of different types of thermostats has been proposed conventionally as means for improving fuel consumption by controlling the cooling water temperature at the required state.

For example, Japanese Patent Application No. 10-227215 discloses, as an example of an engine water temperature control device, a technology according to which "it is judged whether or not a temperature detected by a water temperature sensor exceeds a target temperature, and, when this temperature exceeds the target temperature, the cooling water control valve portion opens at an opening ratio based on the detected temperature, and, when the opening ratio is above a set value, the fan motor of the cooling fan is caused to rotate at a rotation speed that corresponds with the opening ratio to forcedly cool the radiator cooling water".

However, the above-described conventional cooling water temperature control has posed the following problems. That is, where the conventional cooling water temperature control is concerned, unavoidable problems include the cooling water temperature control being performed unnecessarily due to problems such as responsiveness, the target temperature being overshot or undershot in attempts to set the cooling water temperature at the target temperature, and the occurrence of futile water temperature changes (so-called temperature hunting) in repeating the valve operation many times over until the target temperature is reached, these problems being the cause of fuel consumption degradation.

Further, there is the drawback that, because a temperature hunting phenomenon caused by an excessive amount of cooling water flowing when the thermostat valve is opened is readily produced, the tracking and stability of the cooling water temperature are poor due to this temperature hunting, and therefore the stabilized output when the engine load is high is undesirable.

There is also the inconvenience that, because a high water temperature set value is set in consideration of a stable machine due to the above-described overshooting, high water temperature control up to the limits of the permitted range cannot be performed.

There is also the problem that control at a higher water temperature cannot be performed because the stability and tracking of the cooling water temperature are poor due to the variation in the water temperature at the radiator outlet and the variation in the radiator flow rate that is caused by fluctuations in the heat generation of the engine and in the rotation speed of the water pump.

There is also the problem that, because the cooling fan operates after a transition to a low water temperature when the radiator outlet water temperature is high has been determined, the operational timing of the cooling fan is delayed and hence the change to a low cooling water temperature is delayed.

Further, where conventional control is concerned, it is necessary to detect the radiator outlet cooling water temperature in order to make the cooling water temperature linear or close to the ideal temperature. For this reason, a water temperature sensor, water temperature switch, or the like, must be provided at the radiator outlet, and hence costs are high.

In addition, with the above-described conventional cooling water temperature control, even if control to establish a set water temperature has been possible in tests, the actual vehicle is affected by a variety of external factors such as the outside air temperature and inside cabin temperature, which is associated with a deterioration in control. There are therefore also problems such as it not being possible to obtain ideal results.

The present invention was conceived in view of this situation, and has, as an object, to provide a control method for an electronically controlled thermostat control method that makes it possible to set the cooling water temperature appropriately and efficiently in accordance with the engine load when the engine is running, that is also superior in terms of responsiveness and cooling water temperature stability, that appropriately controls the cooling water temperature to a high water temperature or a low water temperature without there being the risk of overshooting or undershooting, temperature hunting, and so forth, and that allows an improvement in the fuel consumption to be achieved more reliably and substantially over the whole range of running states.

DISCLOSURE OF THE INVENTION

In order to achieve this object, the electronically controlled thermostat control method according to the present invention (the invention according to claim 1) is a control method for an electronically controlled thermostat in an engine cooling system that variably sets the cooling water temperature in accordance with the load of an automobile engine, characterized in that, when the engine cooling water temperature is controlled from a first set temperature (high temperature, 105° C., for example) to a lower second set temperature (low temperature, 80° C., for example), the radiator thermal radiation amount when stabilized at the second set temperature is predicted rather than detection of the cooling water temperature being performed, so that temperature hunting does not occur; cooling water temperature control is performed by controlling the electronically controlled thermostat in accordance with this predicted value; and, also during this cooling water temperature control, correction to allow a match between fluctuations in the heat generation amount of the engine and the thermal radiation amount is performed by calculating the heat generation amount (referred to below as engine heat generation correction); correction to cancel fluctuations in the flow rate caused by fluctuations in the rotation speed of the water pump is performed by calculating the flow rate from the rotation speed (referred to below as water pump rotation speed correction); correction to cancel fluctuations in the thermal radiation capacity caused by fluctuations in the radiator outlet cooling water temperature is performed by calculating the outlet cooling water temperature (referred to below as radiator outlet water temperature correction); and correction to cancel a nonlinear characteristic is performed by calculating the opening ratio of the valve portion of the thermostat from the flow rate (referred to below as valve nonlinear correction).

According to the present invention, because, when the cooling water temperature is controlled at a low water temperature in order to prevent knocking, power loss, and so forth when the engine is running with a high load, there is no temperature hunting or the like, which was a conventional problem, and the values detected for the cooling water temperature are not fed back, cooling water temperature control with favorable tracking and stability can be performed.

The electronically controlled thermostat control method according to the present invention (the invention according to claim 2) is a control method for an electronically controlled thermostat in an engine cooling system that variably sets the cooling water temperature in accordance with the load of an automobile engine, characterized in that, when the engine cooling water temperature is controlled from a second set temperature to a higher first set temperature, the radiator thermal radiation amount when stabilized at the first set temperature is predicted rather than detection of the cooling water temperature being performed, so that temperature hunting and overshooting do not occur; cooling water temperature control is performed by controlling the electronically controlled thermostat in accordance with this predicted value and opening the valve portion beforehand so that the set temperature is not exceeded, and, also during this cooling water temperature control, engine heat generation correction, water pump rotation speed correction, radiator outlet water temperature correction, and valve nonlinear correction are performed.

According to the present invention, because, also when the cooling water temperature is controlled at a high water temperature in order to reduce oil friction and so forth when the engine is running with a low load, there is no temperature hunting or the like, which was a conventional problem, and the values detected for the cooling water temperature are not fed back, a water temperature that is as high as is possible can be maintained, an improvement in the fuel consumption can be implemented, an energy conservation effect is obtained, and cooling water temperature control with favorable tracking and stability can be performed.

The electronically controlled thermostat control method according to the present invention (the invention according to claim 3) is characterized by performing prediction control of radiator outlet cooling water temperature when the radiator outlet cooling water temperature is detected in claim 1 or 2.

According to such a constitution, detection means, such as a water temperature sensor, water temperature switch, or the like, for detecting the radiator outlet cooling water temperature are not required.

The electronically controlled thermostat control method according to the present invention (the invention according to claim 4) is characterized in that, when the operation of the cooling fan, which is capable of varying the amount of thermal radiation from the radiator, is controlled in claim 1, 2, or 3, fan estimation control to operate the cooling fan at the maximum rotation speed is performed unconditionally in accordance with the engine load amount without detection of the cooling water temperature and water pump rotation speed being performed.

According to such a constitution, the cooling fan operating time interval is reduced to the required minimum, and, after judging a high engine load, a water temperature reduction can be implemented instantly, whereby an output reduction and knocking can be kept to a minimum.

The electronically controlled thermostat control method according to the present invention (the invention according to claim 5) is characterized in that, when judging the load of the engine in any one of claims 1 to 4, point-system load judging means are used, and the timing for a water temperature transition is controlled by using the load points determined by the load judging means.

According to such as constitution, the status of the engine load can be appropriately grasped, the timing for a water temperature transition is controlled in accordance with the engine load, cooling water temperature control, that is, switching between high water temperature control and low water temperature control can be appropriately and reliably performed, water temperature fluctuations are dispensed with, and an output that is stabilized when the engine is running with a high load can be implemented, whereby an improvement in the fuel consumption can be achieved.

BEST MODE FOR CARRYING OUT THE INVENTION

FIGS. 1 to 10 show an embodiment of the control method for the electronically controlled thermostat according to the present invention.

These figures will first be described below on the basis of FIG. 10 that shows an outline of the whole of an automobile engine cooling system that comprises an electronically controlled thermostat.

Figure 10:
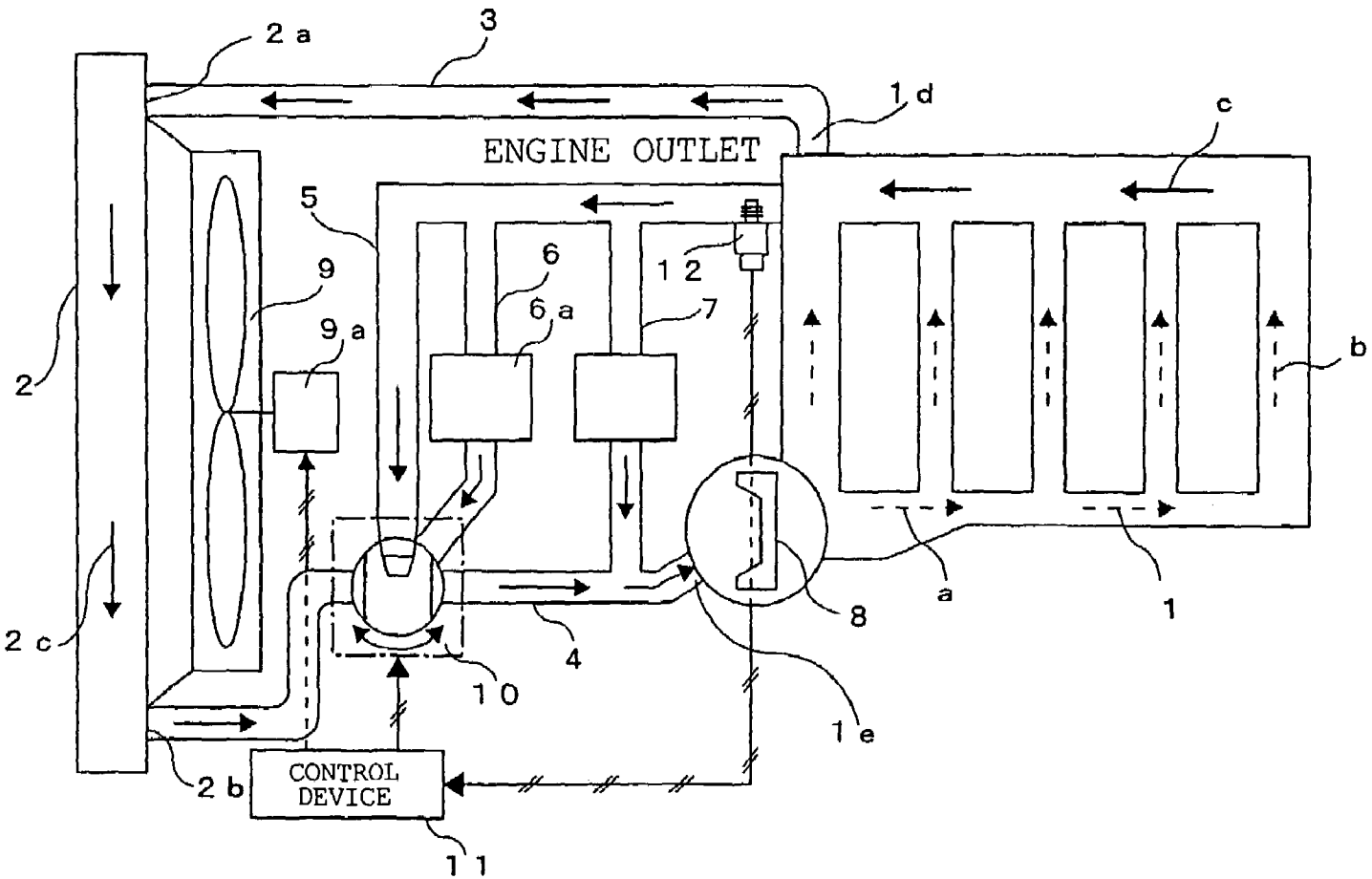
FIG. 10 shows an outline of the engine cooling water system that applies the control method of an electronically controlled thermostat according to the present invention.

In FIG. 10, 1 is an automobile engine constituting an internal combustion engine, the cooling water passage shown by the arrows a, b, and c being formed within the engine 1. 2 is a heat exchanger, that is, a radiator. A cooling water passage 2*c* is formed, as is common knowledge, in the radiator 2, and a cooling water inlet 2*a* and a cooling water outlet 2*b* of the radiator 2 are connected to cooling water paths 3 and 4 respectively that allow cooling water to be circulated between the radiator 2 and the engine 1.

These cooling water paths are constituted by an outflow cooling water path 3 that communicates between a cooling water outlet id provided at the top of the engine 1, and a cooling water inlet 2*a* provided at the top of the radiator 2; and an inflow cooling water path 4 that communicates between a cooling water outlet 2*b* provided at the bottom of the radiator 2 and a cooling water inlet 1*e* provided at the bottom of the engine 1. In addition, a bypass water path 5, which is connected so as to shorten the interval between the cooling water paths 3 and 4, and a heater passage 6, which is connected in parallel with the bypass water path 5, are provided, and a valve unit 10, which constitutes an electronically controlled thermostat that functions as a water distribution valve, is provided at the junction of the cooling water path 4 between the bypass water path 5 and the heater passage 6.

This valve unit 10 is constituted by a butterfly-type valve or the like, for example, and is constituted to allow the flow rate of the cooling water flowing in the cooling water paths 3 and 4 to be adjusted in accordance with an opening/closing operation performed by an electric motor (not shown).

Figure 7:
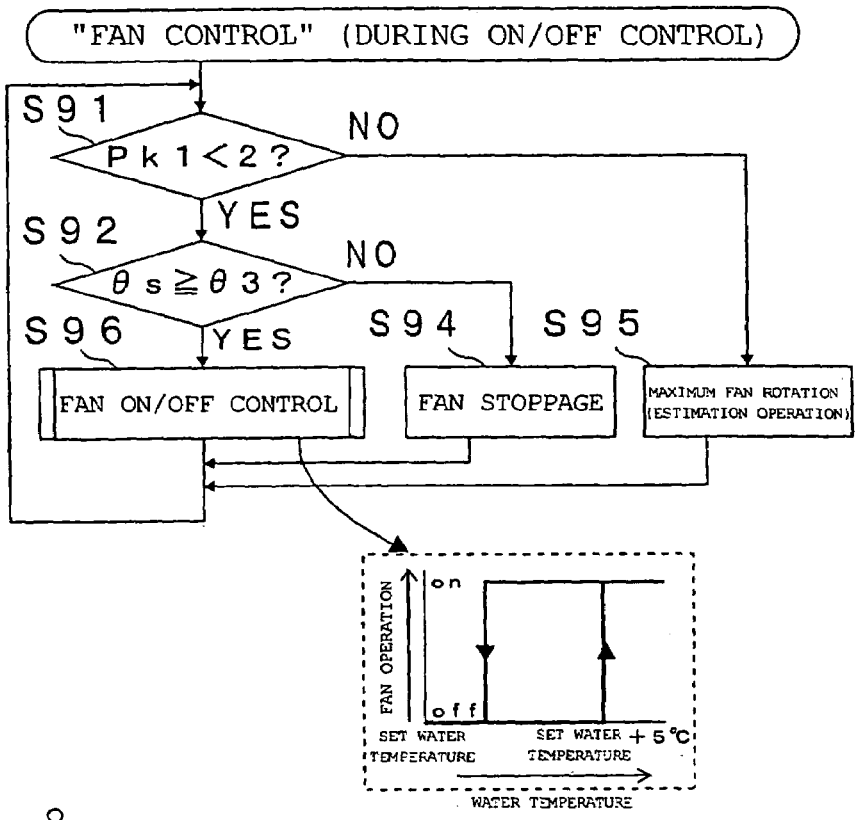
FIG. 7 is a flowchart that shows a subroutine in a case where the fan control of the radiator cooling fan is performed by means of ON/OFF control when the water temperature control of FIG. 1 is performed.

An engine cooling water circulation path is formed by the engine 1, the radiator 2, the cooling water paths 3 and 4, and so forth. Further, 6*a* in the figure denotes heating means. Further, although, in this embodiment, a passage allowing cooling water to flow to the throttle body is provided in parallel with the bypass water path 5 as shown in FIG. 7, a plurality of passages may also be provided.

Further, a water temperature sensor 12, such as a thermistor or similar, for example, is disposed in the outflow cooling water path 3 that lies close to the cooling water outlet 1*d* in the engine 1 (here, one part of the bypass passage 5 in the same location). The constitution is such that the values detected by the water temperature sensor 12, that is, information relating to the engine outlet water temperature, are sent to a control device (ECU: Engine Control Unit) 11 so as to allow the flow of cooling water to be suitably controlled in accordance with the running state of the engine 1, and so forth.

The control device 11 controls a fan motor 9*a* of a cooling fan 9 that is attached to the radiator 2 and forcedly air-cools the cooling water. Further, 8 in the figure represents a water pump that is provided in the vicinity of the inlet 1*e* of the cooling water path 4 on the inflow side of the engine 1.

Further, although a detailed illustration is not provided, information indicating the operating state of each part such as the radiator 1 and the radiator 2 is also sent to the control device 11.

In the case of the above constitution, according to the present invention, the valve unit 10 constituted by an electronically controlled thermostat is characterized by performing control that allows an improvement in the fuel consumption to be achieved more reliably and substantially over the whole range of running states by suitably controlling the cooling water temperature at the required state in accordance with the load of the engine 1 when same is running.

This will be described below by using the flowchart in FIG. 1 and subsequent flowcharts.

Figure 1A:
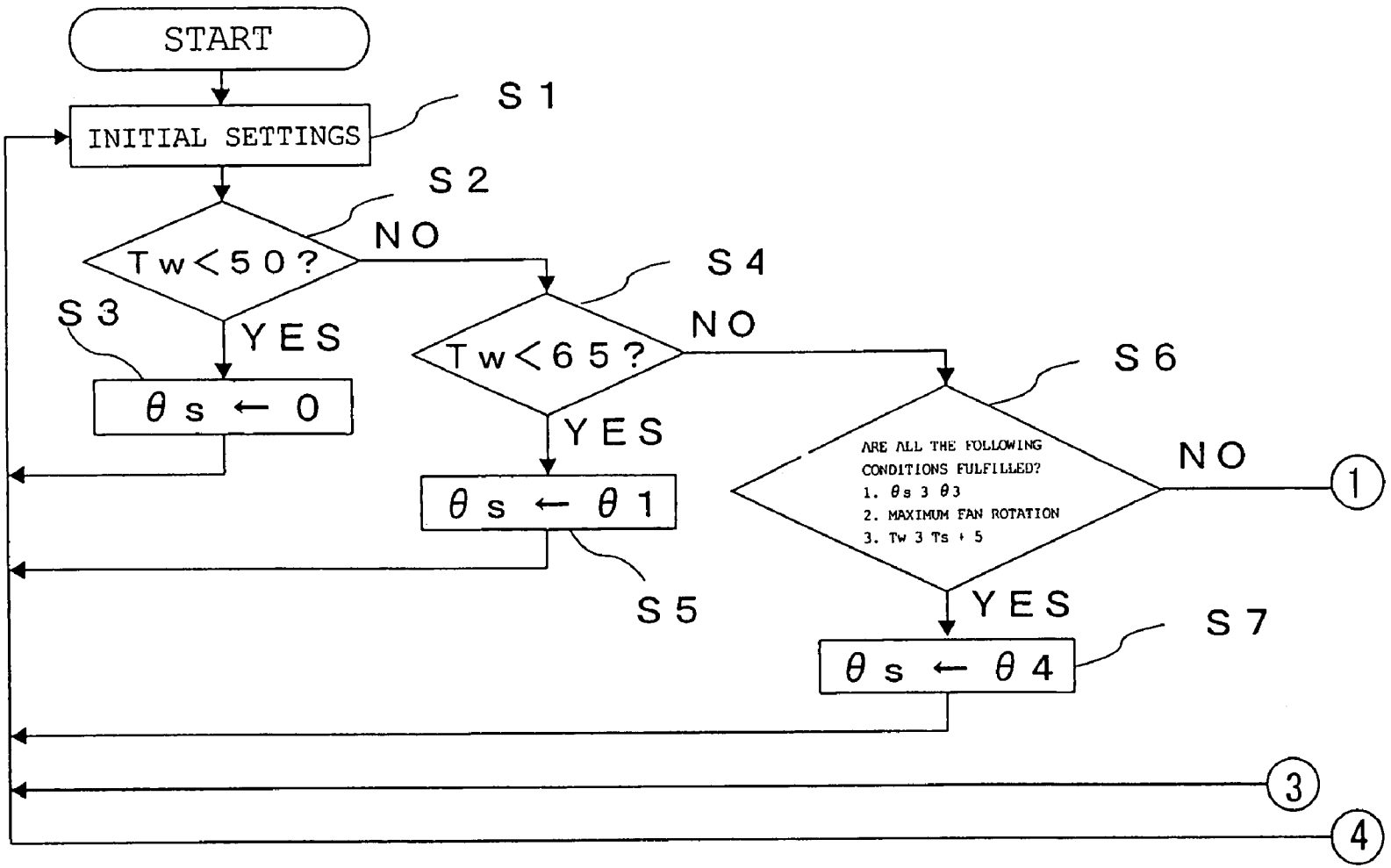
FIG. 1 is a flowchart that shows an embodiment of the control method for an electronically controlled thermostat according to the present invention and that provides an outline of the water temperature control performed by this control method.
Figure 1B:
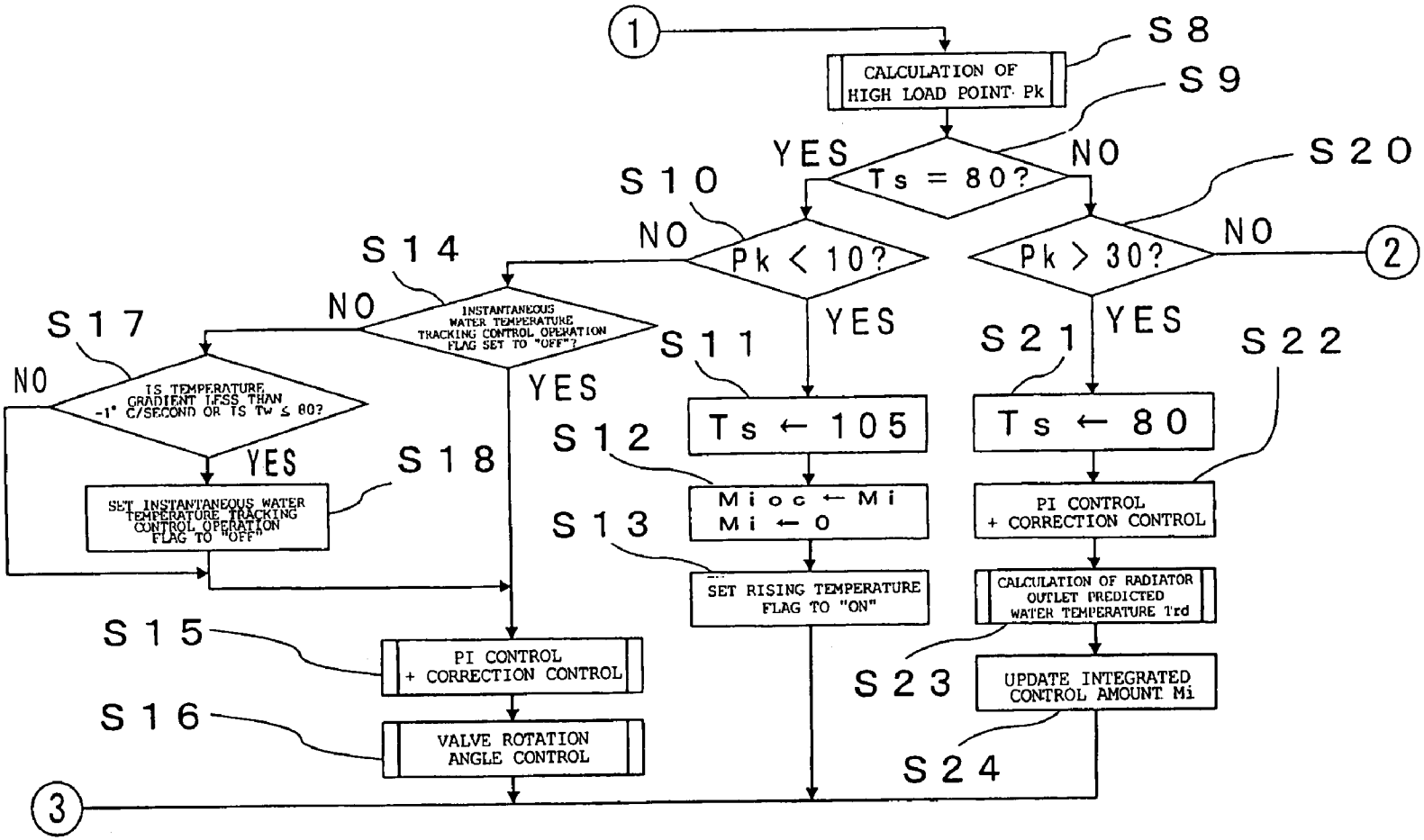
Figure 1C:
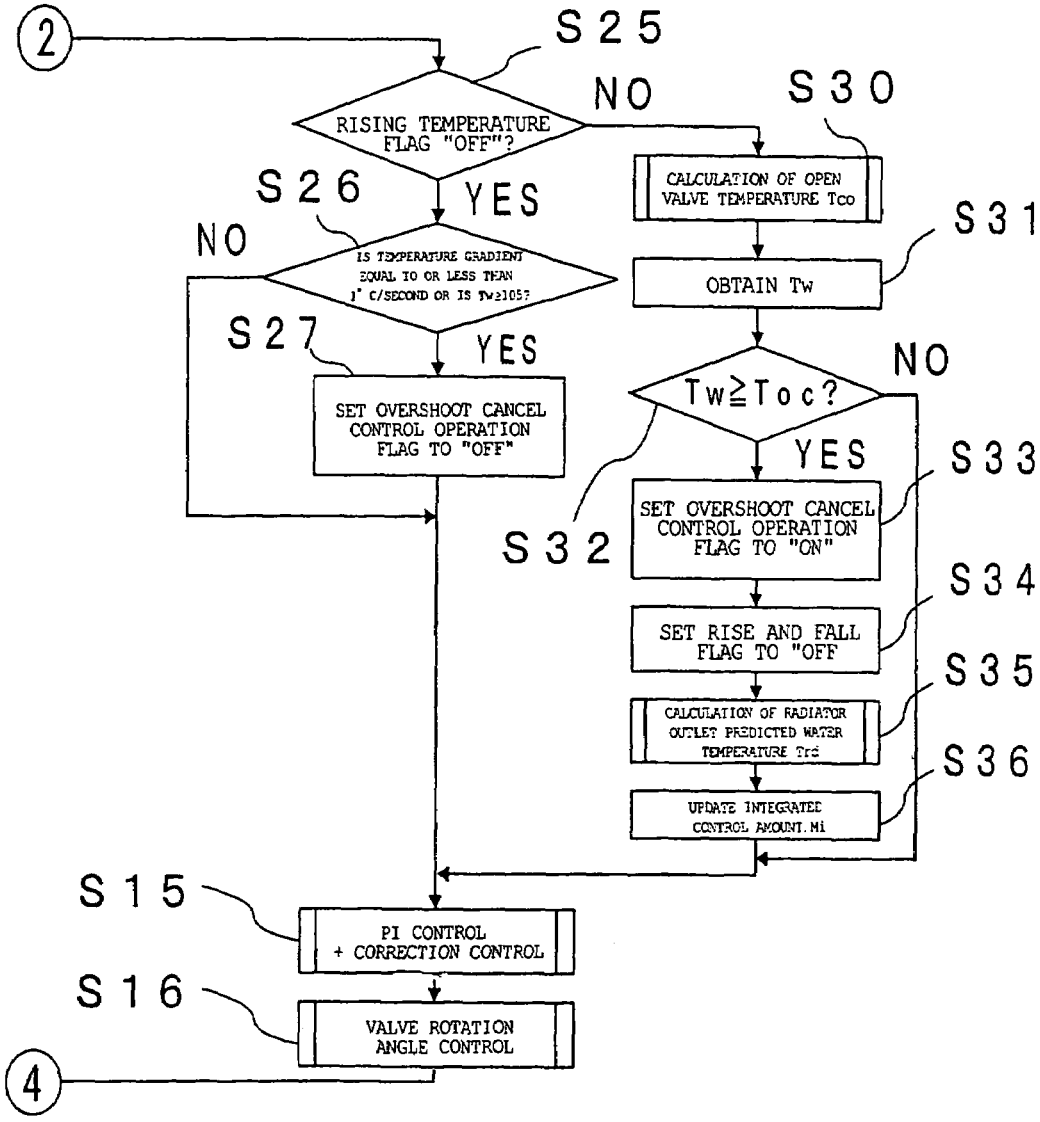

FIG. 1 is a main routine for performing control of the temperature of the engine cooling water. Step S1 involves initial setting in which the high load point Pk is cleared, the rising temperature flag is set to ON, the operation flag for overshoot cancel control (described subsequently) is set to OFF, the operation flag for instantaneous water temperature tracking control (described subsequently) is set to OFF, and Mioc (saved-set Mi when data is present) is set to an initial value. Mi denotes an integrated control amount.

Figure 8:
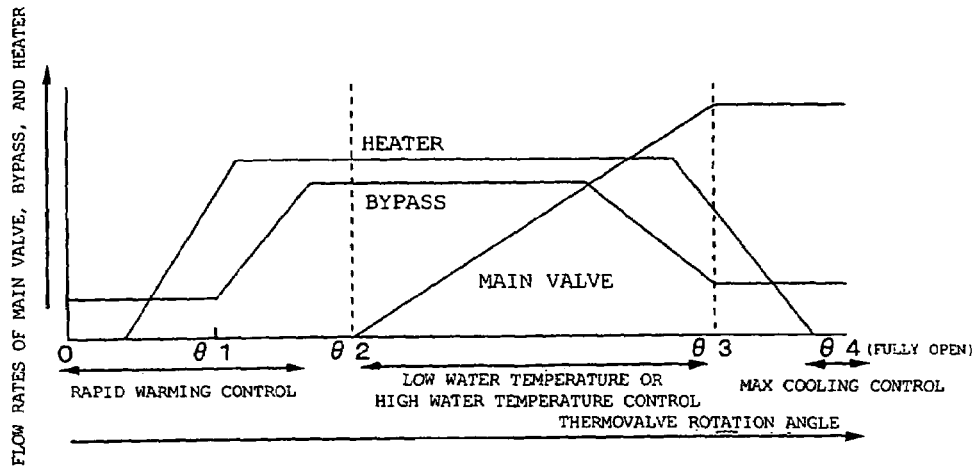
FIG. 8 shows the relationship of the flow rate of each passage with respect to the valve rotation angle when the water temperature control of FIG. 1 is performed.

In steps S2, S4, and S6, it is confirmed whether or not the respective cooling water temperature Tw is 50° C., 60° C., or the set water temperature Ts+5° C., and if so, processing moves to steps S3, S5, and S7 respectively, whereupon the thermovalve rotation angle θs shown in FIG. 8 is set to 0, θ1, and θ4 (fully open) respectively and processing returns to step S2.

Here, in step S6, in addition to the water temperature condition described above, it is confirmed whether or not the thermovalve rotation angle θs is equal to or more than θ3, and whether or not the rotation of the cooling fan is at a maximum. If all these conditions are fulfilled, processing moves to step S7, and if not, processing moves to step S8 in which processing to calculate the high load point Pk shown in FIG. 2 is performed.

Figure 2:
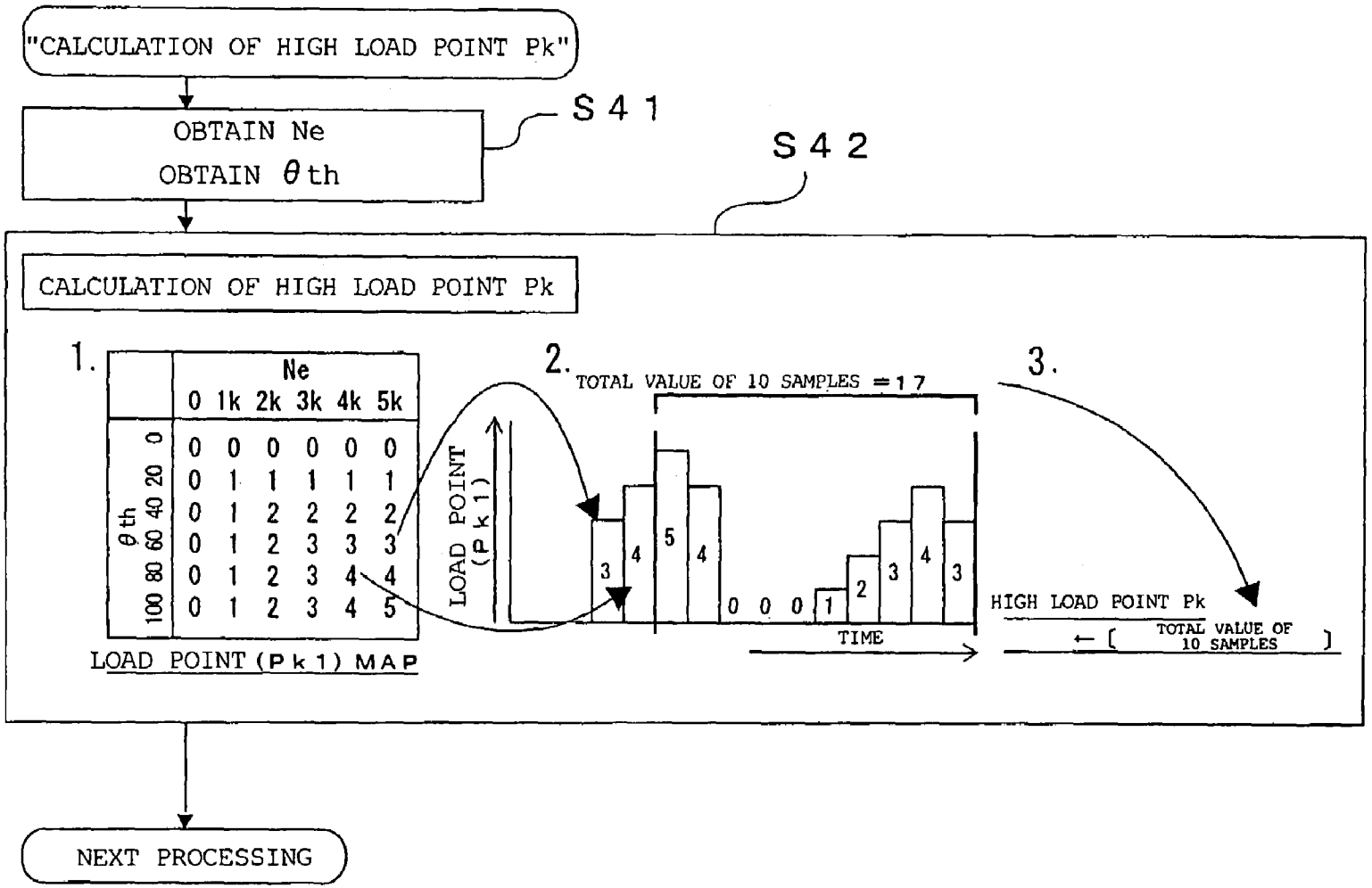
FIG. 2 is a flowchart that shows a subroutine that performs processing to calculate high load point Pk in FIG. 1.

That is, in step S41 in FIG. 2, the engine revolution speed Ne and the throttle opening ratio θ th are obtained, and, in step S42, the high load point Pk is calculated from a load point map on the basis of the engine revolution speed Ne and the throttle opening ratio θ th. Here, the high load point Pk is determined upon grasping the total value of the previous 10 points.

The calculation of the high load point serves to perform switching to either high water temperature control or low water temperature control in which the cooling water temperature control is performed by means of a load detection method based on a point system, the timing for a water temperature transition being controlled by means of load points.

The processing then returns to step S9 in FIG. 1 and it is judged whether or not the set water temperature Ts is 80° C. If so, a high load is judged and processing moves to step S10, whereupon it is judged whether or not the Pk is equal to or less than 10 points. Here, if the Pk is equal to or less than 10 points, the engine load is high, and when this load state is judged to have continued, control is performed to switch the cooling water temperature to low water temperature control.

After flags such as the set water temperature Ts flag has been set to a low water temperature control state in steps S11, S12, and S13, processing returns to step S2.

In addition, when it is judged in step S10 that Pk is equal to or more than 10 points, processing moves to step S14 and it is judged whether or not the instantaneous water temperature tracking operation flag is OFF.

Figure 3:
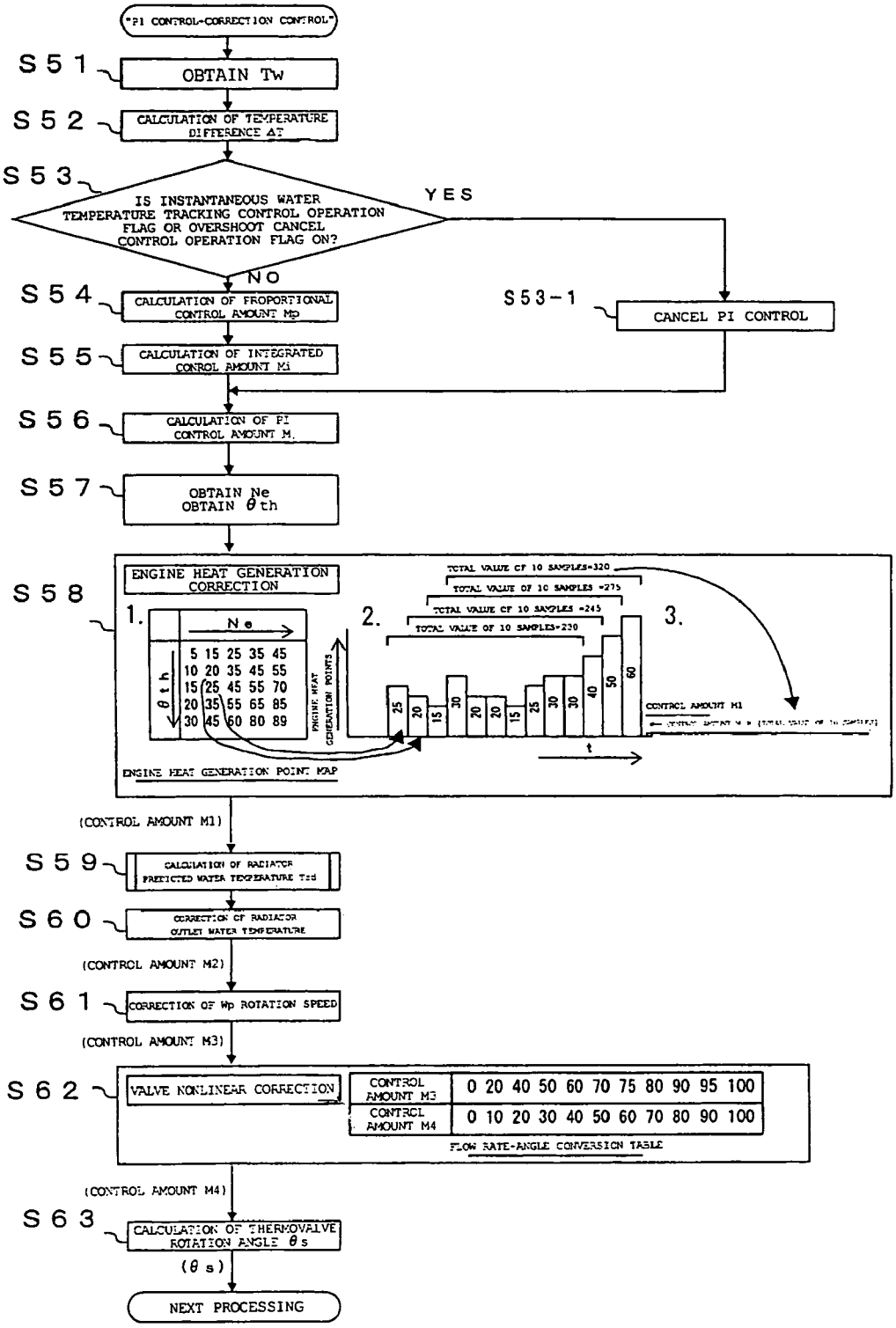
FIG. 3 is a flowchart that shows a subroutine that performs processing for the PI control+correction control in FIG. 1.

When it is judged in step S14 that the flag is OFF, processing moves to step S15 in which the PI control+correction control shown in FIG. 3 are performed. Then, once this control has been performed, valve rotation angle control is performed in step S16, whereupon processing returns to step S2.

Here, the PI control+correction control perform steps S51 to S63 as shown in FIG. 3. That is, water temperature data and other data are obtained and a proportional control amount Mp, an integrated control amount Mi, a PI control amount M, and so forth, are calculated, and engine heat generation correction is performed in step S58. This engine heat generation correction is carried out by grasping the engine heat generation amount and then rendering the amount of heat to be cooled the control amount M1.

After the radiator predicted water temperature Trd has been calculated similarly in step S59, radiator outlet water temperature correction is performed in step S60 to restrict the amount of cooling water flowing into the engine from the radiator outlet.

Then, after water pump rotation speed correction has been performed in step S61, valve nonlinear correction is performed in step S62 and preparations are made so that the control of the flow rate performed by the pump, valve, and so forth can be performed for the required state. Then, once the thermovalve rotation angle θs has been calculated in step S63, processing moves to step S16.

When the flag is judged to be ON in step S14 above, processing moves to step S17, and once the temperature gradient has been confirmed, the flag is set to OFF in step S18 and processing moves to step S15.

Figure 4:
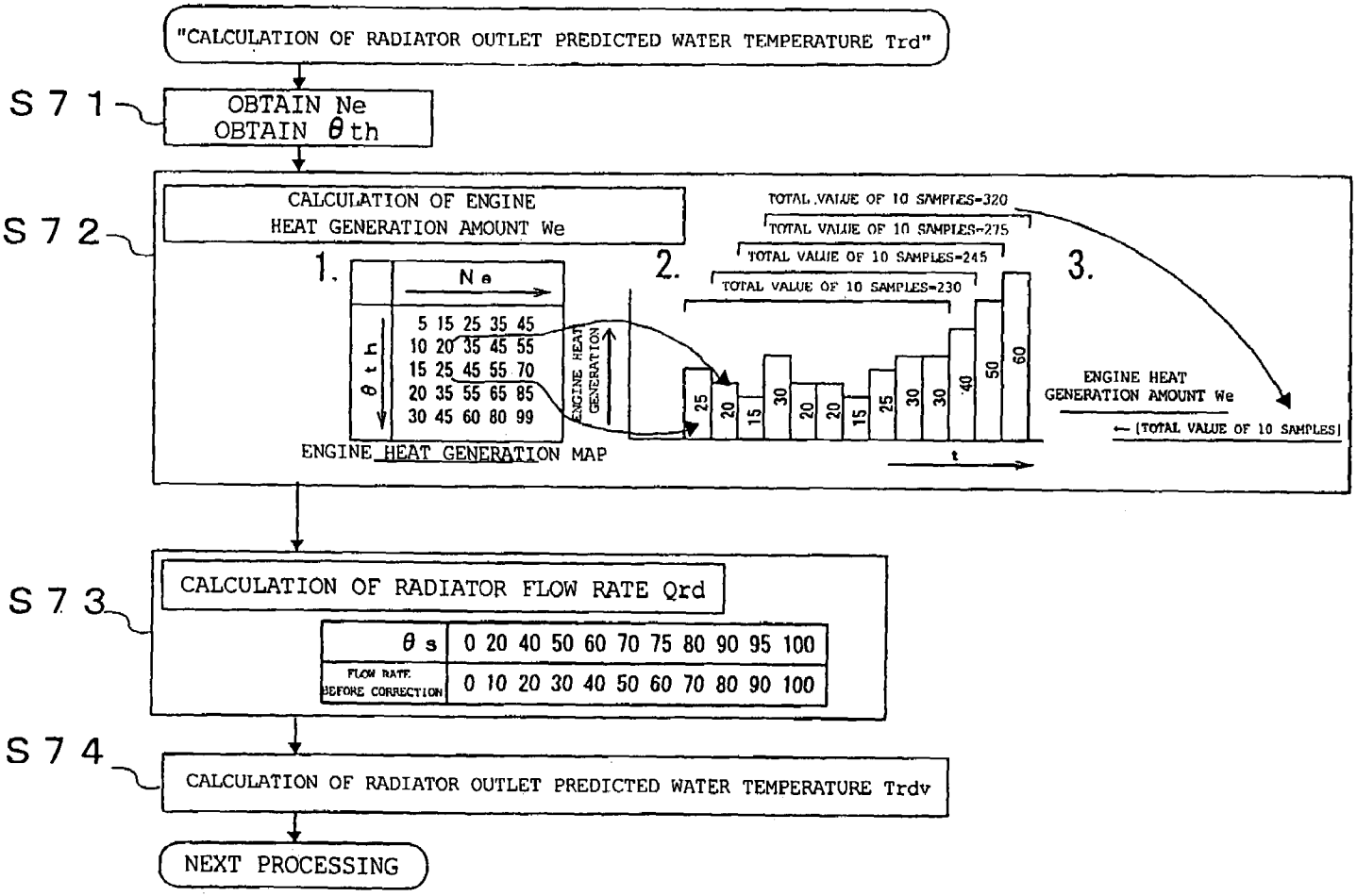
FIG. 4 is a flowchart that shows a subroutine that performs processing to calculate the radiator outlet predicted water temperature Trd in FIGS. 1 and 3.

The calculation of the radiator outlet predicted water temperature Trd in step S59 above is performed as shown in FIG. 4. That is, the engine revolution speed Ne and the throttle opening ratio θth are obtained in step S71, and the calculation of the engine heat generation amount We is performed by means of an engine heat generation map in step S72. Further, a radiator flow rate Qrd may be calculated by means of a table and Ne correction and the radiator outlet predicted water temperature Trd may be calculated in step S74.

Meanwhile, when it is judged in step S9 above that the set water temperature Ts is not 80° C., processing moves to step S20 and beyond, whereupon it is judged whether or not the high load point Pk is larger than 30, and, if larger, it is judged that the load is high and that high water temperature control is to be performed. Processing then moves to step S21, whereupon the set water temperature Ts is set to 80° C., and, after the instantaneous water temperature tracking control operation flag has been set to ON in step S22, the above-described calculation of the radiator outlet predicted water temperature Trd in FIG. 4 is performed in step S23 and the integrated control amount Mi is updated in step S24, and then processing returns to step S2.

Furthermore, when it is judged in step S20 that Pk is equal to or less than 30, processing moves to step S25 and it is judged whether or not the rising temperature flag is OFF. If so, it is judged in step S26 whether or not the temperature gradient is equal to or less than 1° C./second or whether or not the water temperature Tw is equal to or more than 105° C., and, if so, after the overshoot cancel control operation flag has been set to OFF in step S27, PI control+correction control, which are shown in FIG. 3, are performed in step S28 and valve rotation angle control is carried out in step S29, whereupon processing returns to step S2. When it is judged in step S26 that either condition is not fulfilled, step S27 is bypassed and processing moves to steps S28 and S29.

Figure 5:
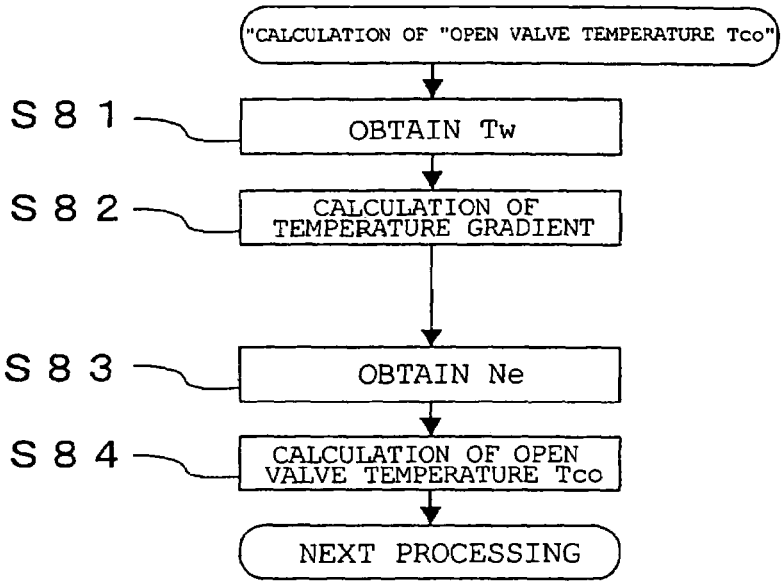
FIG. 5 is a flowchart that shows a subroutine that performs processing to calculate the open valve temperature Tco in FIG. 1.

When it is judged in step S25 that the rising temperature flag is not OFF, processing moves to step S30 and the open valve temperature Toc is calculated. The subroutine is shown in FIG. 5. The water temperature Tw is obtained in step S81, the temperature gradient is calculated in step S82, the engine revolution speed Ne is obtained in step S83, and then the open valve temperature Tco is calculated in step S84, whereupon processing moves to step S31 of FIG. 1.

In step S31, the water temperature Tw is obtained, and the water temperature Tw is compared with the open valve temperature Tco in step S32. If the water temperature is high, processing moves to steps S33 to S36 and, after settings have been made in order to perform an overshoot cancel control operation or similar, processing moves to steps S28 and S29. If the water temperature Tw is low, steps S33 to S26 are bypassed and processing moves to step S28.

Figure 6:
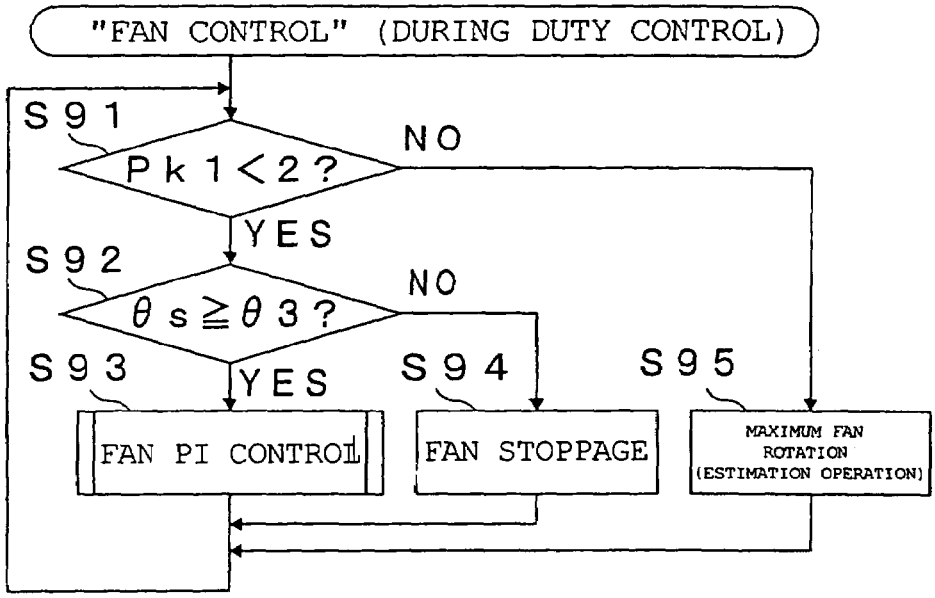
FIG. 6 is a flowchart that shows a subroutine in a case where the fan control of the radiator cooling fan is performed by means of DUTY control when the water temperature control of FIG. 1 is performed.

When control of the cooling fan is performed by means of DUTY control, the subroutine "fan control" (during DUTY control) method shown in FIG. 6 is used, and, when cooling fan control is performed by means of the ON/OFF method, the subroutine "fan control (during ON/OFF control) method shown in FIG. 7 is used.

To explain this further, during the DUTY control of FIG. 6, it is judged in step S91 whether or not the load point PkI is less than 2, and, if so, processing moves to step S92, whereupon it is judged whether or not the thermovalve opening ratio es is equal to or more than θ3 in FIG. 8. Then, if the thermovalve opening ratio θs is equal to or more than θ3, the fan PI control of step S93 (where necessary, correction for disturbance caused by the vehicle speed and the wind is added) is performed. If the thermovalve opening ratio θs is not equal to or more than θ3, processing moves to step S94 and the fan is stopped. Further, if Pk1 is equal to or more than 2 in step S91, an estimation operation so that the cooling fan is driven at a maximum rotation speed is carried out.

Further, during the ON/OFF control of FIG. 7, as shown in step S96, which substitutes step S93 in FIG. 6 above, the fan ON/OFF control is turned ON and OFF between the set water temperature and the set water temperature+5° C.

Here, FIG. 8 is a graph that shows the relationship between the respective flow rates of the main passage, the bypass passage, and the heater passage with respect to the thermovalve rotation angle. When the rotation angle is equal to or less than θ2, rapid warming control is performed; when equal to or more than θ3, MAX cooling control is performed; and when between θ2 and θ3, low water temperature control or high water temperature control is performed.

Figure 9:
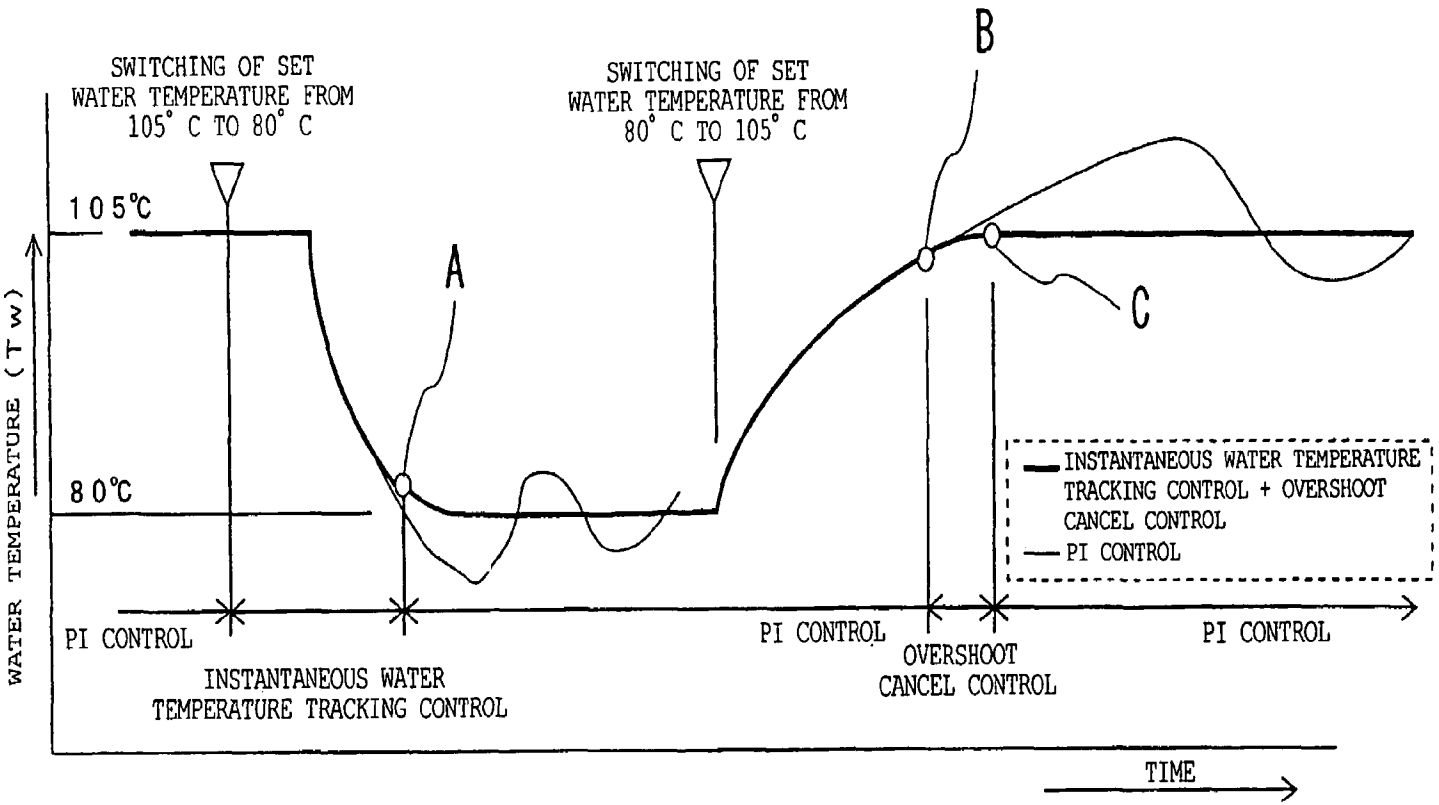
FIG. 9 shows an image of water temperature control at the operation control timing of instantaneous water temperature tracking control and overshoot cancel control.

Further, FIG. 9 shows an image of water temperature control at the operation control timing of instantaneous water temperature tracking control and overshoot cancel control. When the cooling water temperature is controlled from a high temperature to a low temperature, instantaneous water temperature tracking control is performed, and when, conversely, the cooling water temperature is controlled from a low temperature to a high temperature, overshoot cancel control is performed. Otherwise, PI control (+correction control) is performed.

Here, the instantaneous water temperature tracking control operation is executed as follows. That is, until, after switching to a low water temperature, the temperature gradient is equal to or less than −1° C./second or equal to or less than the set water temperature (80° C.), the valve is operated without water temperature feedback. Here, the radiator thermal radiation amount when stabilized at a low set water temperature (80° C.) is predicted and the valve is operated so that this temperature is maintained. Further, during this control, engine heat generation correction, water pump rotation speed correction, radiator outlet water temperature correction, and valve nonlinear correction are performed so as to permit effective operation and prevent degradation in the control caused by disturbance.

In addition, the overshoot cancel control is performed as follows. That is, this control is executed during a rise in temperature after switching to a high water temperature. The valve is completely closed by PI control until the valve is opened. Then, the valve is opened in advance before the set water temperature has been reached (in the time interval established by the time lag between the water temperature change and the valve operation), and the valve is operated without water temperature feedback until the temperature gradient is equal to or less than 1° C./second or the set temperature has been reached. Here, the radiator thermal radiation amount when stabilized at a high set water temperature (105° C., for example) is predicted and the valve is operated so that this temperature is maintained. Naturally, during this interval, engine heat generation correction, water pump rotation speed correction, radiator outlet water temperature correction, and valve nonlinear correction are performed to permit effective operation and prevent degradation in the control caused by disturbance.

The open valve timing of the overshoot cancel control above is established as described below. That is, the time interval (time lag) from the point where the valve is opened until water temperature feedback takes place is estimated beforehand, and an overshooting of the water temperature can be prevented by opening the valve at a point that precedes the point where the water temperature Tw reaches the target water temperature by this time interval. This time interval is inversely proportional to the water pump rotation speed. This is evident from the fact that a higher pump rotation speed results in a faster flow speed.

It goes without saying that the present invention is not limited to or by the structures described in the above embodiment, and that the shape, structures, and so forth, of each of the parts can be suitably changed.

For example, the electronically controlled thermostat described in the above embodiment has a structure that allows the target temperature to be set arbitrarily. More specifically, a thermostat that has a structure comprising a rotary valve that is advantageous in controlling the flow rate, and in which drive is executed by a step motor, may be employed. However, the thermostat employed is not restricted to this thermostat, an electronically controlled thermostat permitting optional temperature control being equally applicable.

Furthermore, the structures of the other constituent parts, cooling water circulation paths, and so forth, as well as the numerical values and so forth described for each part, are not limited to only those specified in the drawings, description, and so forth. A variety of embodiments can be freely adopted. In addition, the descriptions provided for the respective control above merely illustrate one example, it being possible to adopt a variety of embodiments within a range not departing from the spirit of the present invention.

Otherwise, the present invention is also effective in vehicle cooling devices and is equally effective in fuel cell vehicles, irrespective of whether same have two or four wheels and so on.

As the load/point conversion method described in FIG. 2, any method is possible as long as the method permits the load to be calculated by extraction from a MAP of the engine revolution speed Ne and intake load, and then conversion of the result into points without further processing by multiplying a coefficient by an airflow output and injection amount.

INDUSTRIAL APPLICABILITY

With the electronically controlled thermostat control method according to the present invention as described hereinabove, a water temperature state that is as high as possible can be maintained by preventing unnecessary water temperature reduction. As a result, fuel consumption can be considerably improved and futile operation of the valve, fan motor, and so forth, does not take place, and therefore an energy saving effect can also be achieved.

Further, according to the present invention, the tracking and stability of the cooling water temperature are high, whereby an output that is stabilized when the engine load is high can be implemented.

In addition, overshooting, undershooting, and temperature hunting do not occur, and a greater improvement in the fuel consumption afforded by the higher water temperature is achieved together with an improvement in the heater function.

Further, according to the present invention, after it has been judged that the engine load is high, an instantaneous water temperature drop can be implemented and output reduction and knocking kept to a minimum, whereby fuel consumption can be improved.

In addition, because a water temperature sensor is not required at the radiator outlet, a reduction in costs is feasible.

Moreover, according to the present invention, parameters leading to discrepancies between tests and the actual vehicle are, wherever possible, not used, parameters that are not readily influenced being used instead, and therefore correction control is superior to conventional correction control in terms of reproducibility and superior from the standpoint of controllability.

The invention claimed is:

1. A method for controlling an electronically controlled thermostat provided in a cooling system of an internal combustion engine, the method comprising:

predicting a thermal radiation amount of a radiator when a water temperature of engine cooling water is stabilized at a second set temperature without detecting the water temperature not to cause temperature hunting, when the water temperature is controlled from a first set temperature to the second set temperature lower than the first set temperature;

controlling the electronically controlled thermostat to control the water temperature in accordance with the predicted thermal radiation amount;

calculating a heat generation amount of the internal combustion engine;

correcting the control of the electronically controlled thermostat to match fluctuations in the heat generation amount and the thermal radiation amount of the radiator;

calculating a flow rate of the engine cooling water based on a rotation speed of a water pump;

correcting the control of the electronically controlled thermostat to cancel fluctuations in the flow rate caused by fluctuations in the rotation speed;

calculating an outlet water temperature at an outlet of the radiator;

correcting the control of the electronically controlled thermostat to cancel fluctuations in a thermal radiation capacity caused by fluctuations in the outlet water temperature;

calculating an opening ratio of a valve of the electronically controlled thermostat based on the flow rate; and correcting the control of the electronically controlled thermostat to cancel a nonlinear characteristic of the valve.

2. The method according to claim 1, wherein prediction control of the outlet water temperature is performed when the outlet water temperature is detected.

3. The method according to claim 2, wherein a cooling fan varies the thermal radiation amount of the radiator, and wherein a fan estimation control to operate the cooling fan at a maximum rotation speed is performed in accordance with an engine load amount without detecting the water temperature and the rotation speed of the water pump.

4. The method according to claim 3, wherein a point-system load judging method is used when judging a load of the internal combustion engine, and wherein a timing for shifting a set temperature of the engine cooling water is controlled by using load points determined by the point-system load judging method.

5. The method according to claim 2, wherein a point-system load judging method is used when judging a load of the internal combustion engine, and wherein a timing for shifting a set temperature of the engine cooling water is controlled by using load points determined by the point-system load judging method.

6. The method according to claim 1, wherein a cooling fan varies the thermal radiation amount of the radiator, and wherein a fan estimation control to operate the cooling fan at a maximum rotation speed is performed in accordance with an engine load amount without detecting the water temperature and the rotation speed of the water pump.

7. The method according to claim 6, wherein a point-system load judging method is used when judging a load of the internal combustion engine, and wherein a timing for shifting a set temperature of the engine cooling water is controlled by using load points determined by the point-system load judging method.

8. The method according to claim 1, wherein a point-system load judging method is used when judging a load of the internal combustion engine, and wherein a timing for shifting a set temperature of the engine cooling water is controlled by using load points determined by the point-system load judging method.

9. A method for controlling an electronically controlled thermostat provided in a cooling system of an internal combustion engine, the method comprising:

predicting a thermal radiation amount of a radiator when a water temperature of engine cooling water is stabilized at a first set temperature without detecting the water temperature not to cause temperature hunting and overshooting, when the water temperature is controlled from a second set temperature to the first set temperature higher than the second set temperature;

controlling the electronically controlled thermostat to control the water temperature in accordance with the predicted thermal radiation amount;

calculating a heat generation amount of the internal combustion engine;

correcting the control of the electronically controlled thermostat to match fluctuations in the heat generation amount and the thermal radiation amount of the radiator;

calculating a flow rate of the engine cooling water based on a rotation speed of a water pump;

correcting the control of the electronically controlled thermostat to cancel fluctuations in the flow rate caused by fluctuations in the rotation speed;

calculating an outlet water temperature at an outlet of the radiator;

correcting the control of the electronically controlled thermostat to cancel fluctuations in a thermal radiation capacity caused by fluctuations in the outlet water temperature;

calculating an opening ratio of a valve of the electronically controlled thermostat based on the flow rate; and correcting the control of the electronically controlled thermostat to cancel a nonlinear characteristic of the valve.

10. The method according to claim 9, wherein prediction control of the outlet water temperature is performed when the outlet water temperature is detected.

11. Th method according to claim 10, wherein a cooling fan varies the thermal radiation amount of the radiator, wherein a fan estimation control to operate the cooling fan at a maximum rotation speed is performed in accordance with an engine load amount without detecting the water temperature and the rotation speed of the water pump.

12. The method according to claim 11, wherein a point-system load judging method is used when judging a load of the internal combustion engine, and wherein a timing for shifting a set temperature of the engine cooling water is controlled by using load points determined by the point-system load judging method.

13. The method according to claim 10, wherein a point-system load judging method is used when judging a load of the internal combustion engine, and wherein a timing for shifting a set temperature of the engine cooling water is controlled by using load points determined by the point-system load judging method.

14. The method according to claim 9, wherein a cooling fan varies the thermal radiation amount of the radiator, and wherein a fan estimation control to operate the cooling fan at a maximum rotation speed is performed in accordance with an engine load amount without detecting the water temperature and the rotation speed of the water pump.

15. The method according to claim 14, wherein a point-system load judging method is used when judging a load of the internal combustion engine, and wherein a timing for shifting a set temperature of the engine cooling water is controlled by using load points determined by the point-system load judging method.

16. The method according to claim 9, wherein a point-system load judging method is used when judging a load of the internal combustion engine, and wherein a timing for shifting a set temperature of the engine cooling water is controlled by using load points determined by the point-system load judging method.

* * * * *